US007896754B1

(12) United States Patent
Winters

(10) Patent No.: US 7,896,754 B1
(45) Date of Patent: Mar. 1, 2011

(54) CLUB ATTACHABLE GOLF PRACTICE PAD

(76) Inventor: Kenneth Doyle Winters, Dallas, TX (US)

( * ) Notice: Subject to any disclaimer, the term of this patent is extended or adjusted under 35 U.S.C. 154(b) by 0 days.

(21) Appl. No.: 12/629,782

(22) Filed: Dec. 2, 2009

Related U.S. Application Data

(63) Continuation-in-part of application No. 11/968,975, filed on Jan. 3, 2008, now abandoned.

(51) Int. Cl.
*A63B 69/36* (2006.01)

(52) U.S. Cl. ..... 473/226; 473/219

(58) Field of Classification Search ..... 473/219, 473/226, 228, 229, 230, 242, 257
See application file for complete search history.

(56) References Cited

U.S. PATENT DOCUMENTS

| | | | | | |
|---|---|---|---|---|---|
| 1,939,414 | A * | 12/1933 | Sametz | 473/226 |
| D190,318 | S * | 5/1961 | Vallis | D4/129 |
| 3,798,698 | A * | 3/1974 | Conklin, Jr. | 15/167.1 |
| 5,094,559 | A * | 3/1992 | Rivera et al. | 401/132 |
| 5,230,512 | A * | 7/1993 | Tattershall | 473/220 |
| 6,179,723 | B1 | 1/2001 | Evans | |
| 6,393,648 | B1 * | 5/2002 | Reynolds | 15/160 |
| 7,004,850 | B1 | 2/2006 | Hong | |
| 2006/0166754 | A1 | 7/2006 | Kang | |
| 2006/0178223 | A1 | 8/2006 | Brooks | |
| 2006/0252568 | A1 | 11/2006 | Simmons | |

* cited by examiner

*Primary Examiner*—Nini Legesse
(74) *Attorney, Agent, or Firm*—Quick Patents, Inc.; Kevin Prince

(57) ABSTRACT

A training aid is described for facilitating a user swinging a golf club having a golf club head over a ground surface. The training aid includes a resilient spacer having an upper side, a lower side, and at least one peripheral edge connecting the upper side to the lower side, and an attachment means fixed to the spacer and adapted to selectively hold the spacer to the golf club head. With the training aid mounted to a lower side of the golf club head with the attachment means, the user may swing the golf club over the ground surface, the spacer preventing the golf club head from contacting the surface. In some embodiments, a cushioning means may be fixed to the lower side of the spacer.

13 Claims, 2 Drawing Sheets

CLUB ATTACHABLE GOLF PRACTICE PAD

CROSS-REFERENCE TO RELATED APPLICATIONS

This application is a continuation-in-part of patent application Ser. No. 11/968,975, filed on Jan. 3, 2008, and incorporated herein by reference.

STATEMENT REGARDING FEDERALLY SPONSORED RESEARCH AND DEVELOPMENT

Not Applicable.

FIELD OF THE INVENTION

This invention relates to golf training aids, and more particularly to a golf training aid for attaching to a golf club for facilitating golf club swing practice.

DISCUSSION OF RELATED ART

Golf players of all skill levels generally practice the motion of swinging a golf club in order to prepare to play on the golf course. For this purpose, driving ranges, modified golf clubs, and golf club attachments are generally used. It may be desirable to use golf clubs while practicing the golf swing. However, using golf clubs for practicing the golf swing may be problematic because there is a risk of increasing the wear on the clubs through contact with a ground surface while performing the golf swing. During the golf swing, the golf club head may move with great speed, and contact with the ground surface could even cause damage to the golf club (e.g., by scuffing, denting, or scratching the club face and/or head). This risk may be elevated when the golf swing is practiced above a hard surface. Also, because golf clubs are generally constructed of hard materials such as metal alloys and graphite, contact between golf club heads and ground surfaces may damage the ground surface when the ground surface is sensitive and/or it is desirable to preserve the condition of the ground surface. Examples of such ground surfaces include indoor surfaces and garage surfaces.

Golf club attachments are known in the art. For example, U.S. App. No. 20060252568 filed by Simmons on May 1, 2006 describes an elevated golf club foot to assist a golfer in determining the correct distance from the ground to maintain the golf club in order to strike the center of a golf ball. Such an apparatus does not prevent the club head from contacting the ground surface. Furthermore, such an apparatus is not adjustable or usable with various clubs of different sizes.

U.S. App. No. 20060166754 filed by Kang on Jan. 1, 2005 describes a soft pad that may be magnetically attached to the face of a putter. Such an apparatus does not protect the putter from wear on its bottom surface, for example, because the pad attaches and covers only the face of the putter. Also, such an apparatus is designed only for putters, and as such is not well suited for practice with other clubs, such as irons or woods.

U.S. App. No. 20060178223 filed by Brooks on Feb. 21, 2006 describes a removable golf training accessory for use when sliding a golf club along a guide surface that may be composed of a non-abrasive, low friction material. Such an accessory may be unsuitable when a guide surface is not used, as the accessory only contacts the guide surface, and may not protect the face of the club or the head of the club from wear (e.g., by preventing the club head or face from contacting the ground surface).

In my previous patent application Ser. No. 11/968,975, the attachment means disclosed was not optimal for maintaining the device on the golf club head when the device forcefully contacted the floor surface. Of the several attachment means disclosed, the elastic loop proved to be the most reliable. Even still, such a device had weak points where the elastic loop was attached to the spacer.

Therefore, there is a need for a device that prevents a golf club head from contacting a ground surface when a user swings the golf club over the ground surface. Furthermore, such a device would be usable with a variety of different clubs, and would also have a resilient spacer to prevent the golf club head from contacting a ground surface. Such a needed device would not slip off of the golf club head when in use, or fail, even when contacting the ground surface forcefully. The present invention accomplishes these objectives.

SUMMARY OF THE INVENTION

The present device is a training aid for facilitating a user swinging a golf club having a golf club head over a ground surface. The training aid includes a resilient spacer having an upper side, a lower side, and at least one peripheral edge connecting the upper side to the lower side, and an attachment means fixed slidably through the spacer and adapted to hold the spacer to the golf club head. With the training aid mounted to a lower side of the golf club head with the attachment means, the user may swing the golf club over the ground surface, the spacer preventing the golf club head from contacting the surface.

In one embodiment a cushioning means may be fixed to the lower side of the spacer. In an alternate embodiment, the cushioning means may be synthetic turf blades. The lower side may further include a low-friction coating. In some embodiments, the spacer may be made from a foam rubber material, while in other embodiments the spacer may be made from a woven fabric material or a sponge material. In one preferred embodiment, the attachment means may be a continuous elastic loop traversing the spacer.

The present invention prevents a golf club head from contacting a ground surface when a user swings the golf club over the ground surface. Furthermore, the present device is usable with a variety of different clubs, and also has a resilient spacer to prevent the golf club head from contacting a ground surface. The present invention does not slip off of the golf club head when in use, or fail, even when contacting the ground surface. Other features and advantages of the present invention will become apparent from the following more detailed description, taken in conjunction with the accompanying drawings, which illustrate, by way of example, the principles of the invention.

DETAILED DESCRIPTION OF THE PREFERRED EMBODIMENT

Illustrative embodiments of the invention are described below. The following explanation provides specific details for a thorough understanding of and enabling description for these embodiments. One skilled in the art will understand that the invention may be practiced without such details. In other instances, well-known structures and functions have not been shown or described in detail to avoid unnecessarily obscuring the description of the embodiments.

Unless the context clearly requires otherwise, throughout the description and the claims, the words "comprise," "comprising," and the like are to be construed in an inclusive sense as opposed to an exclusive or exhaustive sense; that is to say, in the sense of "including, but not limited to." Words using the singular or plural number also include the plural or singular number respectively. Additionally, the words "herein," "above," "below" and words of similar import, when used in this application, shall refer to this application as a whole and not to any particular portions of this application. When the claims use the word "or" in reference to a list of two or more items, that word covers all of the following interpretations of the word: any of the items in the list, all of the items in the list and any combination of the items in the list. Any use of the word "means" herein is intended to invoke means-plus-function limitation in accordance with 35 U.S.C. §112, sixth paragraph, even if the word "means" follows words describing the function.

Figure 1:
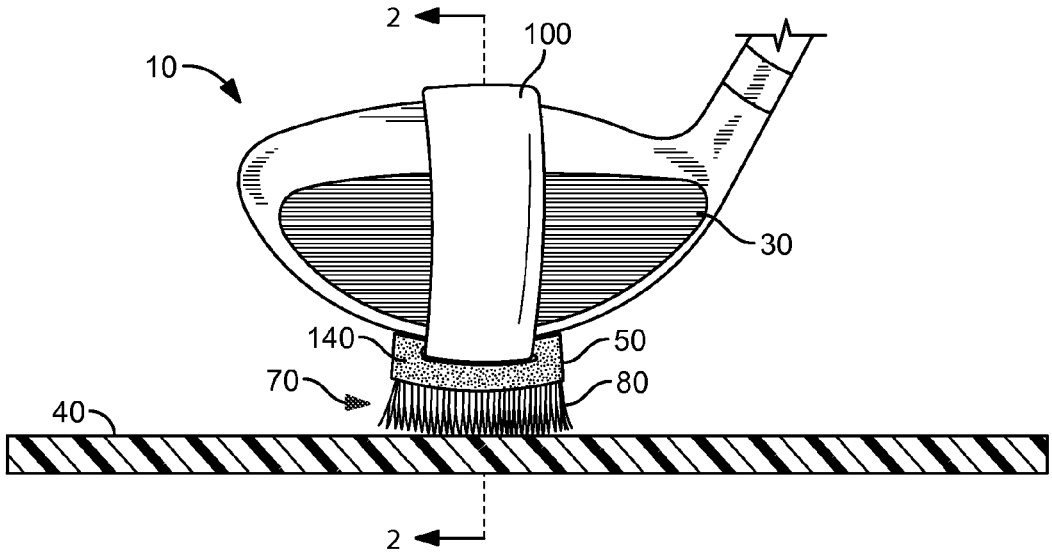
FIG. 1 is a front elevational view an exemplary embodiment of a device for facilitating a user swinging a golf club having a golf club head over a ground surface.
Figure 2:
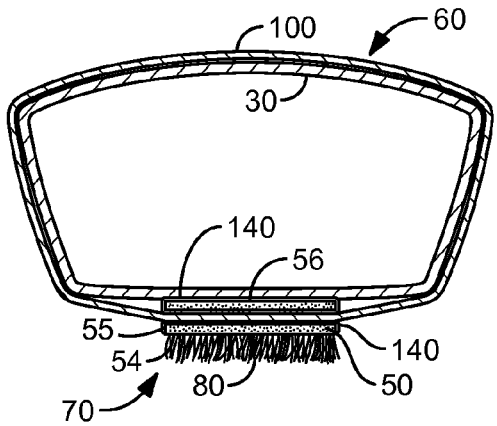
FIG. 2 is a cross-sectional view thereof, taken generally along lines 1-1 of FIG. 1.

FIG. 1 is a side view illustrating an exemplary embodiment of a training aid 10 for facilitating a user swinging a golf club having golf club head 30 over a ground surface 40. The training aid 10 includes a resilient spacer 50, which has an upper side 56, a lower side 54, and at least one peripheral edge 55 connecting the upper side 56 to the lower side 54, as shown in FIG. 2. The resilient spacer 50 prevents the golf club head 30 from contacting the ground surface 40, when the user performs a practice swing, by absorbing at least a portion of the force of impact with the ground surface 40 and creating space between the golf club head 30 and the ground surface 40. The resilient spacer 50 may be in some embodiments resilient enough to protect the golf club head 30 from contacting the ground surface 40, even when the ground surface 40 is a hard surface such as concrete, asphalt, tile, or the like. The resilient spacer 50 is not restricted to any particular shape, and can be, in plan view, round, ovoid, a square, rectangular, or any other suitable shape. The spacer 50 provides additional advantages as it may protect sensitive surfaces, such as indoor surfaces and finished surfaces of garages, for example, by absorbing at least a portion of the force of impact of club head 30 and ground surface 40.

As shown in FIG. 2, the upper side 56 is in contact with or proximate to the golf club head 30, while the lower side 54 may be proximate to the ground surface 40. The peripheral edge 55 comprises at least a portion of the thickness of the resilient spacer 50, and may be of suitable length to prevent the golf club head from contacting ground surface 40.

The resilient spacer 50 may be made from any material, provided that the material absorbs at least a portion of the force exerted on the club head 30 when the spacer 50 contacts the ground surface 40 and maintains a distance between the ground surface 40 and the club head 30. In some embodiments, spacer 50 may be made from a foam rubber material. Alternately, the spacer 50 may be made from a woven fabric material or a sponge material. The spacer 50 may also be made from a combination of the materials listed hereinabove, or a combination of any other suitable cushioning and/or resilient materials.

The training aid 10 also includes an attachment means 60 fixed to the resilient spacer 50 and adapted to hold the resilient spacer 50 to the golf club head 30. The attachment means 60 causes the training aid 10 to be mounted to a lower side of the golf club head 30 such that when a user takes practice golf swings, the training aid 10 remains substantially in contact with the golf club head 30. With the training aid 10 mounted to the lower side of golf club head 30 with the attachment means 60, the user may swing the golf club over the ground surface 40, with spacer 50 preventing the golf club head 30 from contacting the surface 40. In some embodiments, the training aid 10 covers the face of club head 30, such as, for example, when the attachment means 60 encircles the golf club head 30. Covering the face of the club head 30 interferes with making contact with a golf ball, and as such reminds the user to remove the training aid 10 when actually playing golf, such as in a tournament, possibly preventing the user from being penalized for playing with inappropriately modified golf clubs. In such an embodiment, attachment means 60 may be used to repeatedly attach the training aid 10 whenever the user desires to practice golf swings, and then to detach the training aid 10 from the golf club head 30 when the user desires to play golf.

In some embodiments, the cushioning means 70 may be fixed to the lower side 54 of the spacer 50. The cushioning means 70 absorbs at least a portion of the force exerted upon the resilient spacer 50, thereby reducing the force exerted upon the golf club head 30 when contact is made with the ground surface 40 and potentially providing further protection against wear and damage. The cushioning means 70 also increases the space between the golf club head 30 and the ground surface 40, thereby providing further protection to the golf club head 30 and the ground surface 40. This additional space may range from 1-2 centimeters to any desired height, provide that the distance does not substantially interfere with a user's standard golf swing. The cushioning means 70 may be composed of any material that absorbs at least a portion of the force of impact with the ground surface 40, including rubber or a rubber-like material, a plastic, or any form of padding. In some embodiments, the cushioning means 70 may be synthetic turf blades 80. In addition to the aforementioned reasons, the cushioning means 70 also increases the useful life of resilient spacer 50.

FIG. 2 illustrates a cross-sectional view of a preferred embodiment of a training aid 10 for facilitating a user swinging a golf club 20 having a golf club head 30 over a ground surface 40. The training aid 10 includes a resilient spacer 50, which functions as described hereinabove. The training aid also includes an attachment means 60, which, as shown in FIG. 2, may be an elastic loop, such as elastic loop 100. The elastic loop 100 may be fixed through, or traversing, the spacer 50. The elastic loop 100 may also be of sufficient length and elasticity to encircle a variety of golf clubs, and to substantially hold the resilient spacer 50 in contact with a golf club head 30, so that the training aid 10 is not loose enough to move or become detached from the golf club head during practice golf swings. In one embodiment, the elastic loop 100 is able to encircle a subset of golf clubs or a combination thereof, such as woods, irons, wedges, and/or putters. In a preferred embodiment, the elastic loop 100 is able to encircle all golf clubs.

Further, the elastic loop 100 may be pulled through the spacer 50 by force, but otherwise imparts a significant enough frictional contact therewith as to be substantially non-sliding during use. For example, the upper surface 56 and the peripheral edge 55 of the spacer 50 may be coated with a high-friction silicone rubber material to further assist in keeping the spacer 50 in place on the golf club head 30, and to keep the elastic loop 100 from easily sliding through the spacer 50. An inside surface of an aperture traversing the spacer 50 for accommodating the elastic loop 100 may further be coated with the silicon rubber material (not shown).

Figure 4:
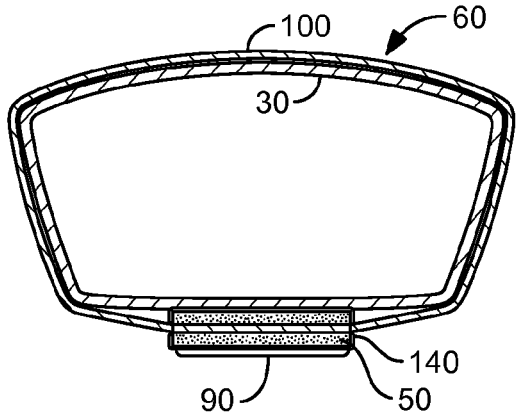
FIG. 4 is a cross-sectional view thereof, taken generally along lines 1-1 of FIG. 1, and illustrating an embodiment having a low-friction coating on a lower side thereof.
Figure 5:
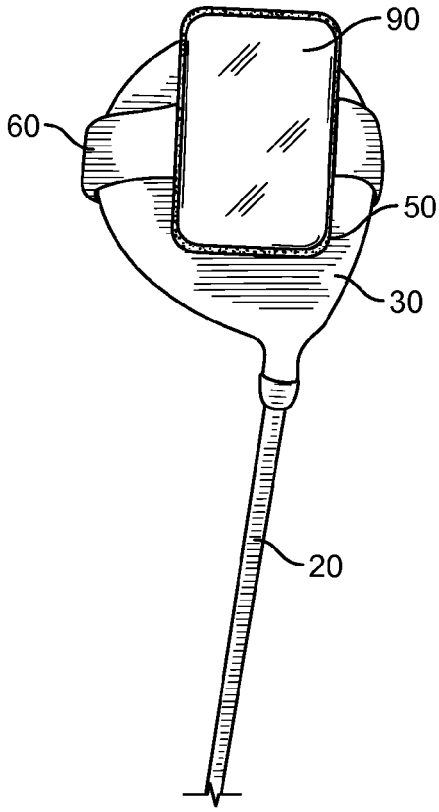
FIG. 5 is a bottom plan view of the embodiment of FIG. 4.

Friction between the resilient spacer 50 and the ground surface 40 may interfere with a user's practice swing and create noise. Furthermore, such friction may reduce the useful life of the training aid 10. Therefore, in some embodiments, the lower side 54 of the resilient spacer 50 may include a low-friction coating, such as the low friction coating 90 shown in FIGS. 4 and 5. The low-friction coating 90 may be any material that allows contacting surfaces to rub against one another with reduced friction and wear, and commercially available examples may include MoSTT™ and GraphitiC™. The low-friction coating 90 is advantageous because it allows the user to practice golf swings with less resistance and noise.

Figure 3:
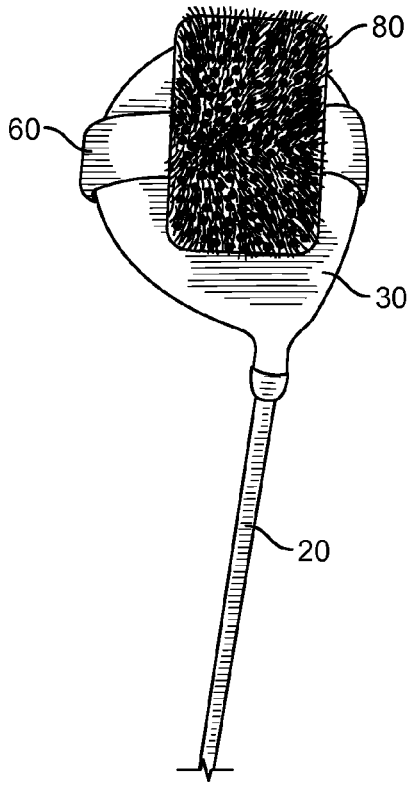
FIG. 3 is a bottom plan view thereof.

FIG. 3 is a bottom plan view illustrating an exemplary embodiment of a training aid for facilitating a user swinging a golf club 20 having a golf club head 30 over a ground surface 40. The training aid 10 includes an attachment means 60 and synthetic turf blades 80, which function as a cushioning material 70, both of which function as described hereinabove.

The spacer 50 may further include a high-friction coating 140, such as silicone rubber, on at least the upper side 56 thereof, and optionally on both the upper side 56 and the peripheral edge 55 thereof (FIG. 2).

While a particular form of the invention has been illustrated and described, it will be apparent that various modifications may be made without departing from the spirit and scope of the invention. For example, multiple attachment means 60 may be used to hold the spacer 50 to the golf club head, instead of just one such means 60. Accordingly, it is not intended that the invention be limited, except as by the appended claims.

Particular terminology used when describing certain features or aspects of the invention should not be taken to imply that the terminology is being redefined herein to be restricted to any specific characteristics, features, or aspects of the invention with which that terminology is associated. In general, the terms used in the following claims should not be construed to limit the invention to the specific embodiments disclosed in the specification, unless the above Detailed Description section explicitly defines such terms. Accordingly, the actual scope of the invention encompasses not only the disclosed embodiments, but also all equivalent ways of practicing or implementing the invention.

The above detailed description of the embodiments of the invention is not intended to be exhaustive or to limit the invention to the precise form disclosed above or to the particular field of usage mentioned in this disclosure. While specific embodiments of, and examples for, the invention are described above for illustrative purposes, various equivalent modifications are possible within the scope of the invention, as those skilled in the relevant art will recognize. Also, the teachings of the invention provided herein can be applied to other systems, not necessarily the system described above. The elements and acts of the various embodiments described above can be combined to provide further embodiments.

All of the above patents and applications and other references, including any that may be listed in accompanying filing papers, are incorporated herein by reference. Aspects of the invention can be modified, if necessary, to employ the systems, functions, and concepts of the various references described above to provide yet further embodiments of the invention.

Changes can be made to the invention in light of the above "Detailed Description." While the above description details certain embodiments of the invention and describes the best mode contemplated, no matter how detailed the above appears in text, the invention can be practiced in many ways. Therefore, implementation details may vary considerably while still being encompassed by the invention disclosed herein. As noted above, particular terminology used when describing certain features or aspects of the invention should not be taken to imply that the terminology is being redefined herein to be restricted to any specific characteristics, features, or aspects of the invention with which that terminology is associated.

In general, the terms used in the following claims should not be construed to limit the invention to the specific embodiments disclosed in the specification, unless the above Detailed Description section explicitly defines such terms. Accordingly, the actual scope of the invention encompasses not only the disclosed embodiments, but also all equivalent is ways of practicing or implementing the invention under the claims.

While certain aspects of the invention are presented below in certain claim forms, the inventor contemplates the various aspects of the invention in any number of claim forms. Accordingly, the inventor reserves the right to add additional claims after filing the application to pursue such additional claim forms for other aspects of the invention.

What is claimed is:

1. A training aid for facilitating a user swinging a golf club having a golf club head over a ground surface, the training aid comprising:

a resilient spacer having an upper side, a lower side, and at least one peripheral edge connecting the upper side to the lower side, the spacer further includes a high-friction coating on at least the upper side thereof; and an attachment means fixed slidably through the spacer and adapted to hold the spacer to the golf club head;

whereby with the training aid mounted to a lower side of the golf club head with the attachment means, the user may swing the golf club over the ground surface, the spacer preventing the golf club head from contacting the surface.

2. The training aid of claim 1 wherein a cushioning means is fixed to the lower side of the spacer.

3. The training aid of claim 2 wherein the cushioning means includes synthetic turf blades.

4. The training aid of claim 1 wherein the lower side includes a low-friction coating.

5. The training aid of claim 1 wherein the spacer is made from a foam rubber material.

6. The training aid of claim 1 wherein the spacer is made from a woven fabric material.

7. The training aid of claim 1 wherein the spacer is made from a sponge material.

8. The training aid of claim 1 wherein the attachment means is a continuous elastic loop traversing the spacer.

9. The training aid of claim 1 wherein the spacer further includes a high-friction coating on the peripheral edge thereof.

10. The training aid of claim 1 wherein the high-friction coating is a silicone rubber material.

11. The training aid of claim 9 wherein the high-friction coating is a silicone rubber material.

12. A training aid for facilitating a user swinging a golf club having a golf club head over a ground surface, the training aid comprising:

a foam rubber resilient spacer having an upper side, a lower side, and at least one peripheral edge connecting the upper side to the lower side, a high-friction silicone rubber coating on the upper side and the peripheral edge thereof;

a cushioning means is fixed to the lower side of the spacer;

a continuous elastic loop slidably traversing through the spacer and adapted to hold the spacer to the golf club head;

whereby with the training aid mounted to a lower side of the golf club head with the attachment means, the user may swing the golf club over the ground surface, the spacer preventing the golf club head from contacting the surface.

13. The training aid of claim 12 wherein the cushioning means includes synthetic turf blades.

* * * * *